United States Patent [19]

Novitski

[11] Patent Number: 4,826,115

[45] Date of Patent: May 2, 1989

[54] SELF-LOCKING MOUNTING CLIP SYSTEM

[75] Inventor: Michael Novitski, Green Bay, Wis.

[73] Assignee: Krueger, Inc., Green Bay, Wis.

[21] Appl. No.: 177,141

[22] Filed: Apr. 4, 1988

[51] Int. Cl.[4] ..... E04G 5/06

[52] U.S. Cl. ..... 248/225.2; 248/243; 312/245

[58] Field of Search ..... 248/225.2, 222.2, 223.3, 248/223.4, 224.1, 224.2, 224.4, 225.1, 243; 312/245, 263; 211/87, 88, 90, 191, 192, 193, 182; 108/108

[56] References Cited

U.S. PATENT DOCUMENTS

| | | | |
|---|---|---|---|
| 4,013,254 | 3/1977 | Boundy | 248/224.4 X |
| 4,098,480 | 7/1978 | Neumann | 248/224.4 X |
| 4,165,852 | 8/1979 | Chervenak | 248/225.2 |
| 4,197,952 | 4/1980 | Defouw | 211/191 |
| 4,618,192 | 10/1986 | Kelley | 312/245 |
| 4,700,916 | 10/1987 | Bastian | 248/225.2 |
| 4,733,841 | 3/1988 | Wilson | 312/245 X |

*Primary Examiner*—J. Franklin Foss

*Attorney, Agent, or Firm*—Fuller, Puerner & Hohenfeldt

[57] ABSTRACT

A system for mounting storage cabinets and the like to a vertical frame comprises a mounting clip that has a plurality of notched angled connectors. The angled connectors are designed to engage cooperating slots in the vertical frame. The angled nature of the connectors requires that the cabinet be moved in three steps to engage the plates and notches with the vertical frame, thereby reducing the risk of the cabinet becoming accidentally dislodged from the frame.

2 Claims, 2 Drawing Sheets

SELF-LOCKING MOUNTING CLIP SYSTEM

BACKGROUND OF THE INVENTION

1. Field of the Invention

This invention pertains to mounting devices, and more particularly to apparatus for removably mounting and locking storage equipment to vertical supports.

2. Description of the Prior Art

Various types of office furniture and accessories have been developed in recent years that improve work place aesthetics and productivity. The concept of modular components that can be readily rearranged to suit changing work place needs is now well accepted.

A requirement of modular office equipment is that it be sufficiently versatile to interfit with numerous other types of equipment. For example, cabinets, work baskets, and similar document retaining components must be able to be located and mounted in a variety of locations with minimum cost and effort.

A well-known design for removably mounting storage cabinets and the like involves interfitting them with vertical wall panels or similar structures having strong frames that contain a series of vertically spaced slots. The slots are designed to accept tabs or hooks that are attached to the cabinet or other component to be hung from the frame. U.S. Pat. No. 4,013,254 shows a mounting structure in which hooked tabs engage holding frame slots. The tabs and slots are designed such that a horizontal motion is sufficient to cause the tabs to enter the slots, and a subsequent vertical motion lowers the tab hooked portions to engage the frame portions adjacent the slots. When in place, only a vertical motion is required to raise the cabinet and tabs such that they disengage the frame. As a result, it is relatively easy to accidentally dislodge the tabs and enable the cabinet to fall. That problem is recognized in the U.S. Pat. No. 4,013,254 , and a solution is proposed therein that involves the addition of a spring-loaded locking mechanism. However, that solution is costly. Further, even with a locking mechanism, a cabinet is susceptible to being jostled loose if the locking member is not properly in place.

U.S. Pat. No. 4,541,599 discloses a mounting and locking system wherein hooked tabs engage vertically spaced slots in a mounting frame. Some of the tabs are horizontally angled with respect to the other tabs, such that the components to be mounted to the frame must initially be positioned at an angle to the frame. After the component is assembled to the frame, it is necessary to rotate it to the straight position. Consequently, any shelving or similar connection between two mounted components can not be joined to the components prior to assembly to the frame. That construction severely limits the usefulness of the mounting design of the U.S. Pat. No. 4,541,599.

Other apparatus for mounting shelves or the like to upright frames may be seen in U.S. Pat. Nos. 1,504,523; 3,570,798; 3,511,193; and 4,159,814. However, none of the foregoing patents teaches means suitable for mounting modular storage cabinets in a modern office work station.

SUMMARY OF THE INVENTION

In accordance with the present invention, a self-locking system for mounting cabinets to a support structure is provided that is more reliable against accidental cabinet dislodgement than was previously available. This is accomplished by apparatus that includes a mounting clip having angled connectors that require simultaneous movement in two directions to engage and disengage from the support structure.

The support structure may be conventional. For instance, it may be a vertical mounting frame or standard having aligned vertically spaced slots. The portions of the frame between the slots are designed to support the cabinet or similar component by means of the mounting clip.

The mounting clip preferably has a number of angled connectors joined to the cabinet by appropriate means. Each connector has a short stem portion with generally parallel top and bottom surfaces that are generally perpendicular to the plane of the cabinet back. Extending from each stem is an angular plate. The plates may be shaped as regular parallelograms. One end of the parallelogram is joined to the connector stem with the angular plate angling downwardly away from the cabinet back. The parallelogram sides are dimensioned so as to fit within a slot in the mounting frame.

To insert the angled connectors into the frame, their free ends must be horizontally aligned with the frame slots. The free ends of the angled connectors are inserted a short distance horizontally into the corresponding slots, but further insertion requires a simultaneous downward motion of the cabinet and mounting clip until the clip connectors are fully inserted into the frame. As a result, the mounted cabinet is very difficult to accidentally dislodge, because the cabinet must undergo simultaneous motion in both horizontal and vertical directions, and then in a horizontal direction, for the angled connectors to be removed from the frame slots.

In the preferred embodiment, each angled connector and the mounting clip base cooperate to form a vertically extending notch in the mounting clip. The notch engages the mounting frame material between the slots, thereby adding to the security of the cabinet mounting. With the clip notch, the cabinet must undergo three separate motions to be removed from the frame: a vertical motion to disengage the notches from the frame, a combined horizontal and vertical motion, and then a horizontal motion to withdraw the angular plates from the slots.

Other advantages and features of the invention will become apparent to those skilled in the art upon reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
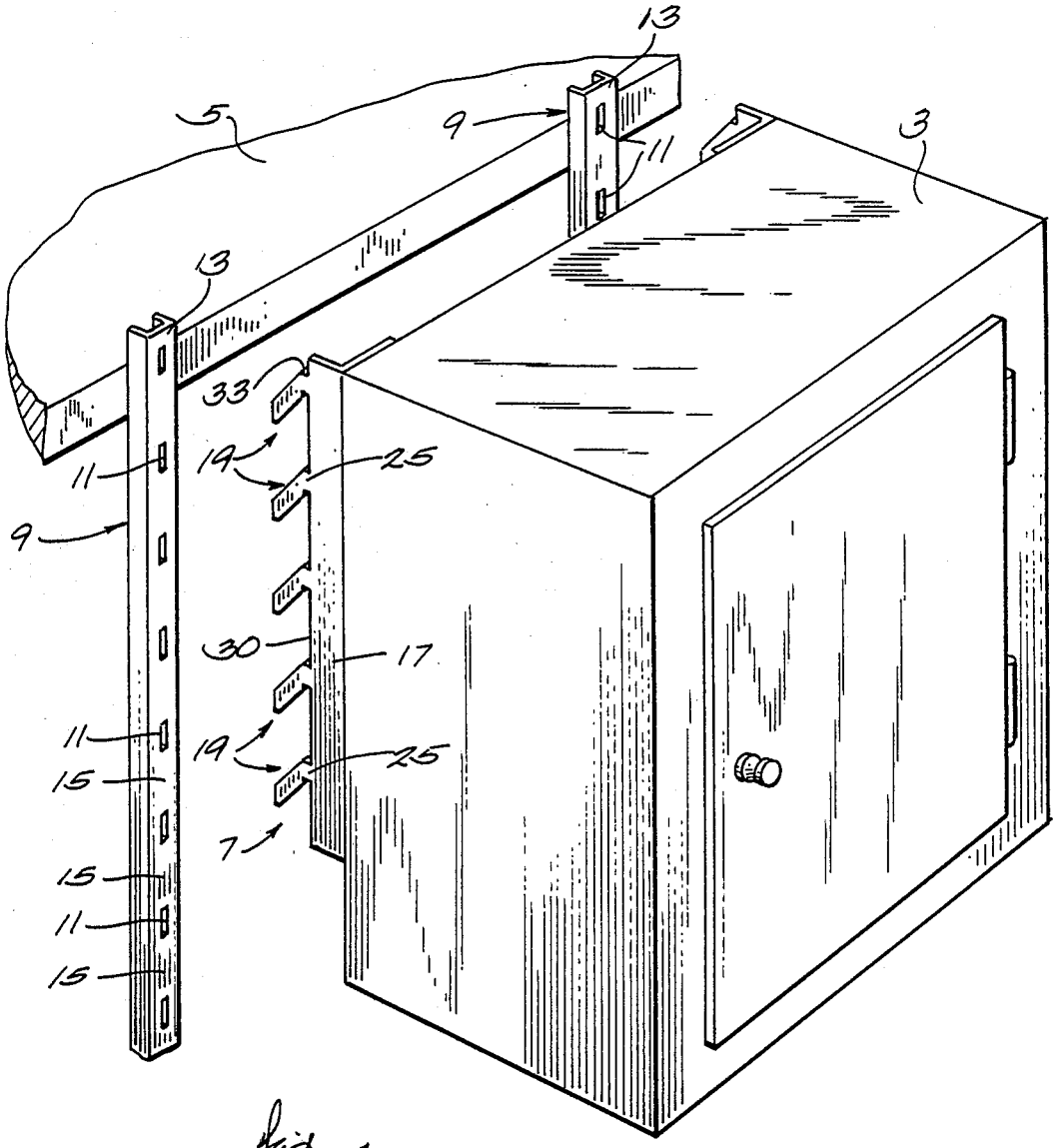
FIG. 1 is a perspective view of the self-locking mounting clip system of the present invention.

Referring to FIG. 1, a self-locking mounting clip system 1 is illustrated that includes the present invention. The mounting system 1 is particularly useful for mounting a wide variety of document storage components to vertical supports in a work place environment. For example, the mounting system may be used to assemble a cabinet, represented by reference numeral 3 to a sturdy support structure represented by reference numeral 5. Other typical applications include mounting a paperbasket to a vertical wall panel in an office. Thus, it will be understood that the invention is not limited to any particular type of support structure or to the type of component mounted to the support structure.

In accordance with the present invention, the self-locking mounting clip system 1 comprises at least one mounting clip 7 and an upright frame member 9 for each mounting clip. The frame members 9 are depicted as having channel cross-sections. However, any shape structural member of sufficient strength and rigidity is acceptable, such as angle irons and H-shaped cross-sectional members. In each instance, the frame member is formed with a series of vertically aligned vertically oriented slots 11 that pass through a front wall 13 of the frame member. The slots 11 are preferably equidistantly spaced, with a land 15 of the frame member material between adjacent slots.

To mount the cabinet 3 or other component to the support structure 5, the mounting clips 7 preferably are fastened to the back side of the cabinet. Looking also at FIGS. 2 and 3, each mounting clip comprises a base portion 17 and a series of angled connectors 19 joined to the base. To attach the mounting clip to the cabinet, a suitable flange or similar member is employed. The flange is designed to suit the particular storage component that is to be mounted to the support structure. With a component such as cabinet 3, a flange 21 that makes a right angle with the base 17 is satisfactory, but other attachment configurations are also acceptable. Conventional screws 23 may be used to attach the mounting clip to the cabinet.

Figure 2:
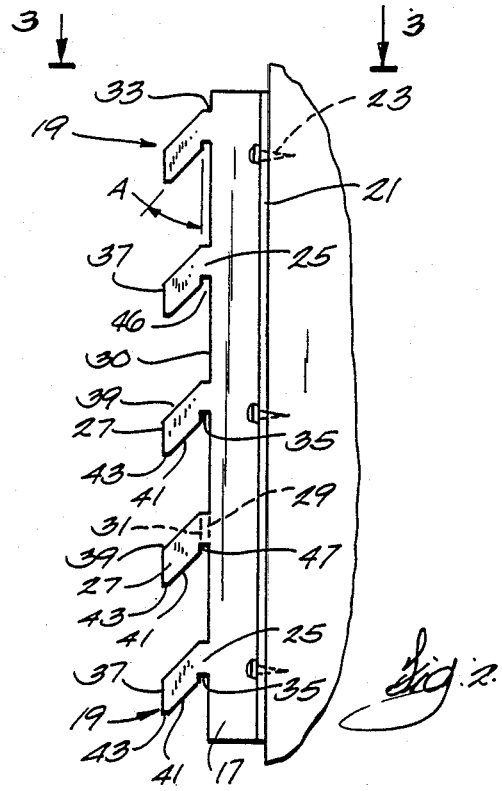
FIG. 2 a side view of the mounting clip of the present invention.
Figure 3:
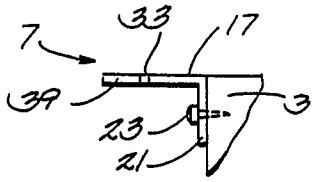
FIG. 3 is a view taken along lines 3—3 of FIG. 2.

With particular attention to FIG. 2, each angled connector 19 comprises a short generally horizontal stem 25 and an angular plate 27. The stem first end 29 is integrally joined to the mounting clip base 17 along the free edge 30 thereof. The angular plate 27 is integrally joined to the stem 25 at the second end 31 thereof. Each stem has top and bottom surfaces 33 and 35, respectively. The angular plate 27 of each angled connector 19 is preferably formed as a parallelogram having an outside end 37 and an opposed inside end 47 that is joined to the stem second end 31. The angular plate outside end 37 is preferably vertical when the mounting clip 7 is in the operative position shown. The opposed sides 39 and 41 of each angular plate make angles of approximately 45° with the stem second end 31. Consequently, the angular plate side 41 and the base free edge 30 form a crotch 46 therebetween.

Figure 4:
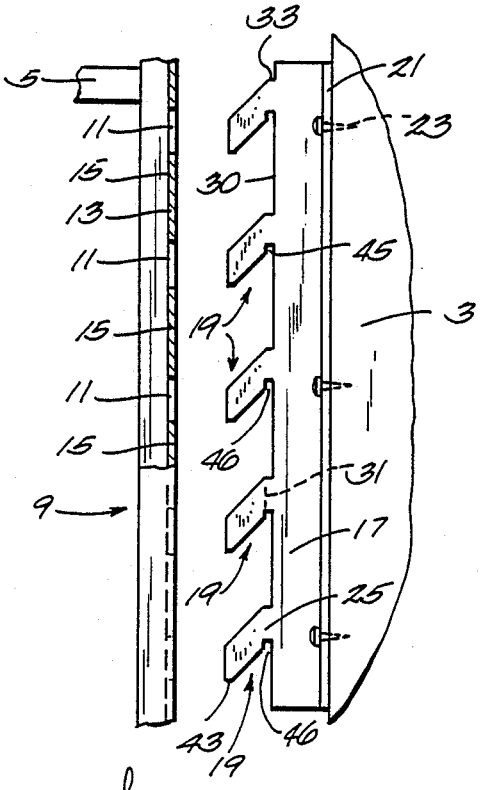
FIG. 4 is a side view of the mounting system of the present invention during a first stage of the mounting process.
Figure 5:
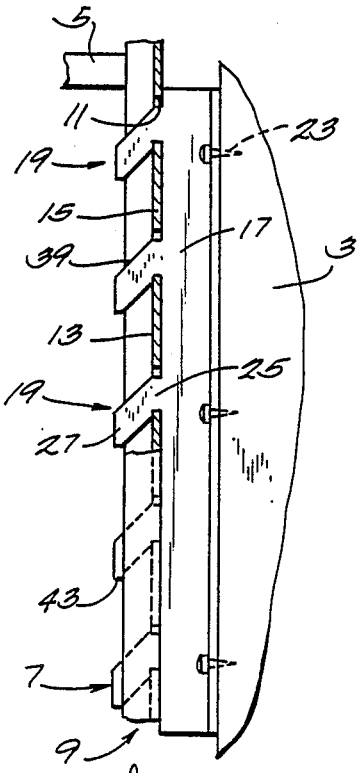
FIG. 5 is a side view of the mounting system of the present invention in the completely assembled condition.

Turning to FIGS. 4 and 5, the cabinet 3 is mounted to the support structure 5 by means of the mounting clip system 1 by first aligning the outer ends 37 of the mounting clip angled connectors 19 with the slots 11 in the frame member 9. The cabinet and mounting clip 7 are then moved horizontally toward the frame until the angular plate ends 37 enter the corresponding slots. To facilitate insertion of the angular plates, the lower corners 43 thereof are chamfered. Once the angular plate ends have entered the frame member slots, the cabinet and mounting clip must undergo a vertical downward motion simultaneously with a horizontal motion in order for the angular plates to completely enter the slots, FIG. 5. Consequently, to remove the cabinet from the support structure, a reverse bidirectional motion of the cabinet and mounting clips is required, thereby increasing the difficulty of removing the cabinet from the support structure and decreasing the risk of accidentally dislodging the cabinet.

Further in accordance with the present invention, the mounting clip 7 is formed with a notch 45 between the base portion 17 and each of the angular plates 27. Each notch 45 is defined by a portion of the free edge 30 of the base, the lower surface 35 of the stem 25, and a portion of the angular plate end 47, which is longer than the second end 31 of the stem. The length of the stem bottom surface 35 is slightly greater than the thickness of the wall 13 of the mounting frame 9.

When the mounting clip 7 fully engages the frame member 9, notches 45 engage the respective lands 15 between the slots 11. Notch and land engagement contribute to the permanence of the connection between the cabinet 3 and the support structure 5. To remove the cabinet, a three-step procedure is required: the cabinet must be vertically moved to disengage the notches from the frame member lands, the cabinet must be moved simultaneously in horizontal and vertical directions to partially disengage the angular plates 27 from the slots, and the cabinet must be moved in a horizontal direction to completely remove the angular plates from the slots. Therefore, removing the cabinet requires a conscientious effort to perform the required sequence of events, and unintentional or accidental removal is unlikely.

Thus, it is apparent that there has been provided, in accordance with the invention, a self-locking mounting clip system that fully satisfies the objects, aims and advantages set forth. While the invention has been described in conjunction with specific embodiments thereof, it is evident that many alternatives, modifications, and variations will be apparent to those skilled in the art in light of the foregoing invention. Accordingly, it is intended to embrace all such alternatives, modifications, and variations as fall within the spirit and broad scope of the amended claims.

I claim:

1. A mounting clip comprising:

a. a base having an attachment end and a free edge;

b. means for fastening the base attachment end to a first component; and c. at least one angled connector having a parallelogram portion with first and second sides and first and second ends, the angled connector being joined to the base free edge to from a crotch between the parallelogram portion first side and the base free edge, and wherein the first and second parallelogram sides made angles of approximately 45° with the base free edge, and wherein the angled connector defines a stem interposed between the parallelogram portion and the base free edge, the stem having first and second ends and top and bottom surfaces, the stem first end being joined to the base free edge and the stem second end being joined to the parallelogram portion first end, so that the stem lower surface is interposed between the parallelogram portion first side and the base free edge.

2. A self-locking mounting clip system for removably mounting a first component to a second component comprising:

a. a frame member having a wall of a predetermined thickness, the wall defining a plurality of vertically aligned vertically oriented slots of predetermined length, the frame member being attached to the second component; and b. at least one mounting clip adapted to removably engage the frame member comprising:

i. a base having a first end fastened to the first component and a free edge; and ii. at least one angled connector having a parallelogram portion lying in a generally vertical plane with first and second sides and first and second ends, the vertical distance between the angled connector first and second sides being slightly shorter than the length of the slots in the frame member wall, the angled connector being joined to the base free edge and extending generally horizontally therefrom the form a crotch between the parallelogram portion first side and the base free edge, so that the angled connector fits within a selected slot of the frame member by an initial horizontal motion and a subsequent combined vertical and horizontal motion.

* * * * *